United States Patent [19]

Schneider et al.

[11] 4,357,017

[45] Nov. 2, 1982

[54] AUTO RACING GAME WHEREIN A NUMBERED ARRAY AND PLAYER-ACTUATED DISCS DETERMINE RACE CAR MOVEMENT

[76] Inventors: Herman E. Schneider, 5493 Omar St., Fremont, Calif. 94538; Daniel A. Stein, 4400 Central Ave., #114, Fremont, Calif. 94536

[21] Appl. No.: 173,462

[22] Filed: Jul. 30, 1980

[51] Int. Cl.[3] ..... A63F 3/00; A63F 9/02

[52] U.S. Cl. ..... 273/246; 273/353

[58] Field of Search ..... 273/246, 138 R, 353

[56] References Cited

U.S. PATENT DOCUMENTS

| | | | |
|---|---|---|---|
| 441,099 | 11/1890 | Hoyt | 273/353 |
| 1,153,395 | 9/1915 | Lehman | 273/138 R X |
| 1,548,507 | 8/1925 | Brown | 273/353 |
| 1,619,279 | 3/1927 | Wagner | 273/353 |
| 3,176,990 | 4/1965 | Aliff | 273/353 X |
| 3,462,152 | 8/1969 | Royston | 273/246 |
| 3,481,605 | 12/1969 | Giraurd et al. | 273/246 X |
| 3,951,412 | 4/1976 | Adams | 273/246 |
| 4,264,076 | 4/1981 | Duncan | 273/246 |

FOREIGN PATENT DOCUMENTS

| | | | |
|---|---|---|---|
| 10760 | of 1899 | United Kingdom | 273/353 |

*Primary Examiner*—Richard C. Pinkham
*Assistant Examiner*—Scott L. Brown
*Attorney, Agent, or Firm*—George B. Almeida

[57] ABSTRACT

A game board comprising a playing surface having indicia thereon defining an oval race track, with toy vehicles adapted to be moved around respective lanes of the track, and additional indicia on the playing surface for advancing vehicle positions, for indicating the number of laps completed by each vehicle, and for determining any of various troubles encountered during the race. Player-actuated wheelies, and means for launching same, cooperate with the indicia on the playing board, to determine the movement forward or backward of each vehicle, generally in response to the degree of skill of the player.

4 Claims, 6 Drawing Figures

AUTO RACING GAME WHEREIN A NUMBERED ARRAY AND PLAYER-ACTUATED DISCS DETERMINE RACE CAR MOVEMENT

BACKGROUND OF THE INVENTION

The invention relates to game boards and particularly to a game board wherein a plurality of movable playing pieces, representing racing autos, are selectively and competitively moved about a race track in response to respective player-actuated means for advancing the pieces.

Game boards with various types of movable playing pieces, adapted for movement along given tracks, paths, courses, etc., in response to player-actuated means for advancing the pieces, are generally well known in the art, as typified by U.S. Pat. No. 3,462,152 to W. C. Royston, U.S. Pat. No. 4,062,545 to B. G. Witney, etc.

Likewise, game boards are generally available which simulate competitive movement between racing vehicles over successive spaces defining a race track, in response to means for determining the number of spaces the vehicles move, forward or backward, as typified by U.S. Pat. No. 3,462,152 of previous mention.

The means for selectively advancing the playing pieces in board games include chance devices, such as dice, spinners, cards, etc., as well as skill devices such as mechanical launchers, object tossing devices, electronically controlled devices, etc., such as typified by U.S. Pat. Nos. 3,462,152 and 4,062,545 of previous mention, and U.S. Pat. No. 4,052,064 to J. T. Kennoy, U.S. Pat. No. 4,060,245 to E. G. Duch, U.S. Pat. No. 4,171,814 to T. Tamano, etc.

SUMMARY OF THE INVENTION

The invention provides a new and exciting auto racing game, which closely simulates the competitive conditions which exist between racing vehicles in an actual race and further includes the associated problems or hardships experienced in a race. The means for advancing the playing pieces includes player/driver assigned and actuated means, wherein the number of spaces advanced is determined primarily by the skill of the player/driver.

The game comprises a playing board with a playing surface provided with indicia defining; an oval race track with a plurality of racing lanes, each having an equal number of spaces; a selected arrangement of numbered squares for determining the extent of advancement of the playing pieces on the track; charts with movable markers designating the number of laps to be raced, as well as the number of laps completed; and penalty sections defining given troubles encountered during the race. The game includes movable toy vehicles for progressing competitively around the oval track, and player-actuated movement means, which are used in combination with the numbered squares and penalty sections indicia, to determine the extent and direction of movement of respective vehicles in the lanes.

Thus, the vehicles are advanced by propelling a small flat annular disc, or "wheelie", (symbolizing a race car tire) onto the numbered squares array on the playing surface of the board, and by moving the vehicle the number of spaces along the respective lane corresponding to the number of the square upon which the wheelie lands. If the wheelie lands on the indicia penalty sections designating the various problems, the player/driver must comply with the corresponding associated penalty, i.e., must lose one or more turns, must move his vehicle back a selected number of spaces, laps, etc.

It is accordingly an object of the invention to provide a competitive auto racing game for a number of players/drivers.

It is another object to provide an auto racing game wherein movement of the vehicles is determined by the skill with which player-actuated wheelies are propelled onto a numbered squares arrangement on the board's playing surface.

A further object is to provide an auto racing game wherein penalties are imposed on a player/driver when his wheelie lands on portions of the playing surface designating various race-associated problems.

A still further object is to provide an auto racing game wherein a wheelie is flipped onto the playing surface by pressing on the edge thereof with a flipper member.

DESCRIPTION OF THE PREFERRED EMBODIMENTS

Figure 1:
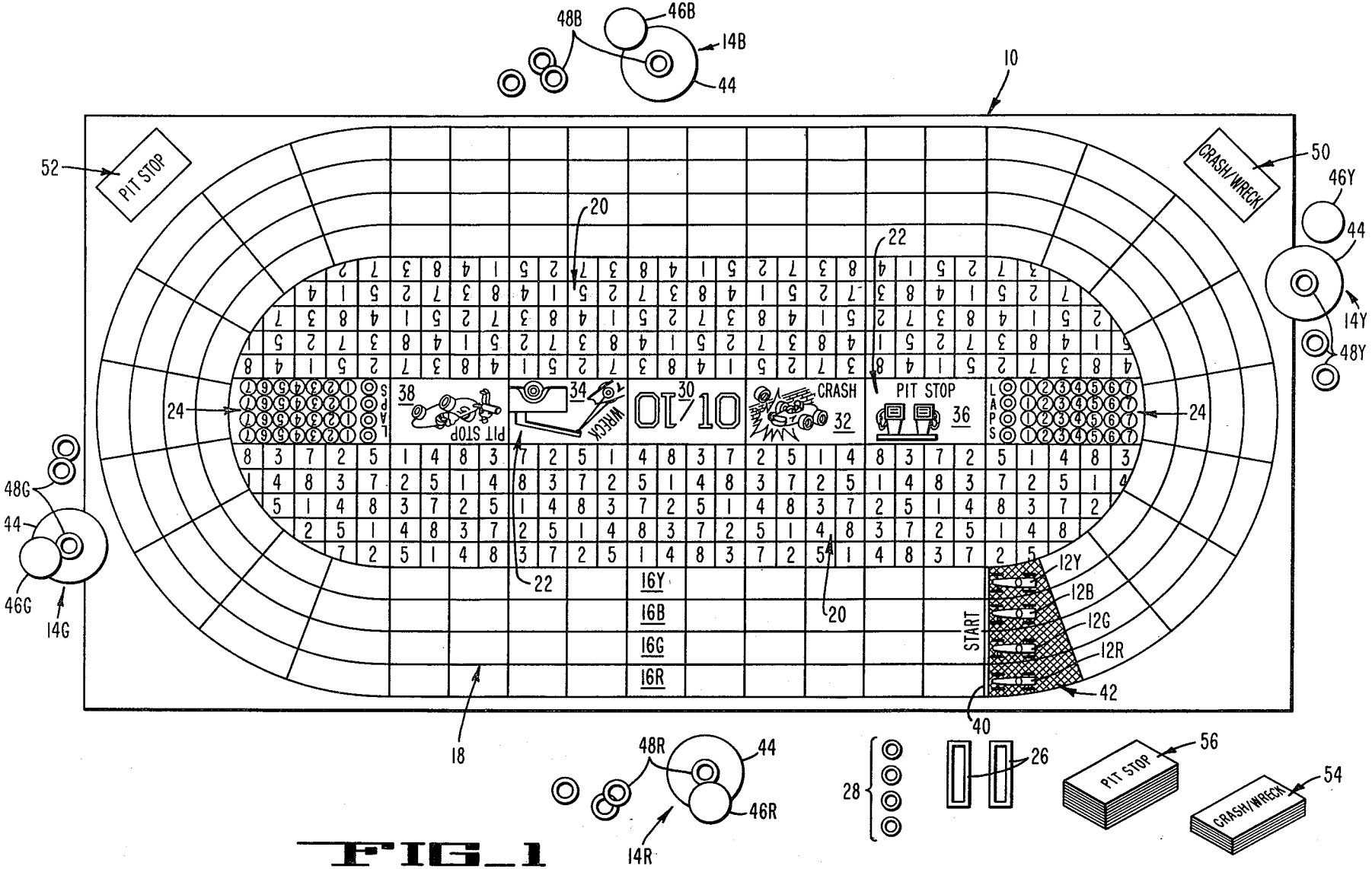
FIG. 1 is a plan of the playing surface of the game board of the invention showing the various indicia, as well as the player-assigned race cars and movement means.
Figure 2:
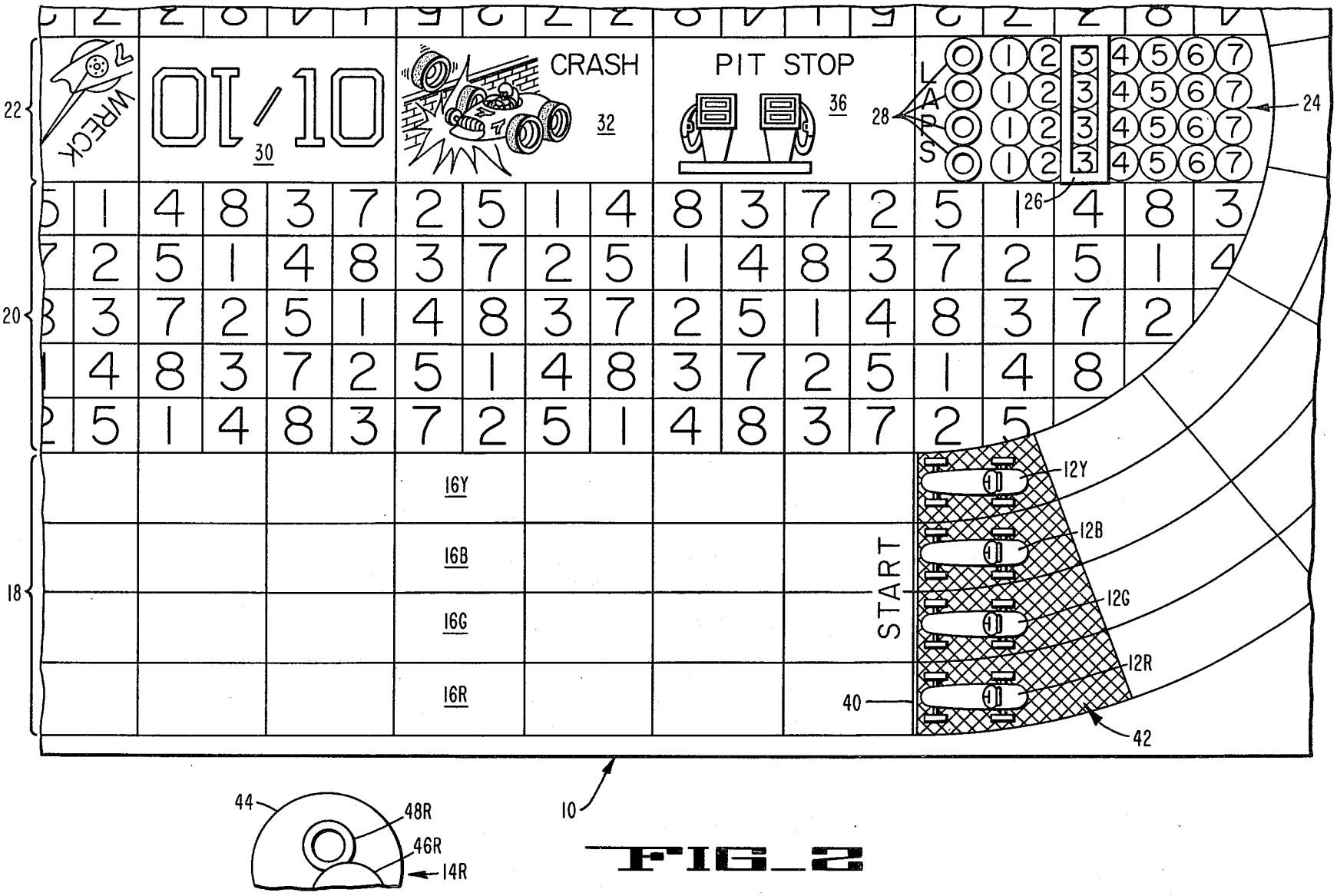
FIG. 2 is a plan of an enlargement of a portion of the game board showing various indicia in greater detail.

Referring to the FIGS. 1 and 2 the auto racing game is played by two or more players, i.e. "drivers", and includes a game board 10, a plurality of driver-assigned playing pieces, i.e. toy race cars 12, and a plurality of driver-assigned/actuated movement means 14, disposed at each of the (four) sides of the game board. To facilitate the description, the drivers' race cars, etc., are herein designated as red (R), green (G), blue (B) and yellow (Y), whereby accordingly, there are RGBY race cars 12, disposed on respective lanes 16 of an oval race track 18, respectively. The RGBY drivers are assigned RGBY movement means 14, respectively. Obviously, the lanes are identified by the particular race car and the driver thereof, as determined at the start of the game, and thus, the lanes may be identified by the color corresponding to the color of the race car. Thus, the lanes themselves are not color coded herein. However, the lanes as well as the race cars may be color coded, whereby each driver places his car on the lane with matching color.

The game board 10 is formed of, for example, an 18 inch by 36 inch piece of corregated cardboard, plastic sheet, hardboard, etc., which preferably is hinged at the middle of the longer length to facilitate packaging, portability, storing, etc. The board 10 includes a playing surface comprising the oval track 18 formed, by way of example only, of the four lanes 16. Any practical number of lanes, race cars 12, etc., may be used, wherein accordingly, any number of player/drivers up to the total number of lanes and race cars may play at one time. The lanes are divided into identical and preselected numbers of spaces, wherein the minimum space is long enough to allow a race car to be positioned thereon.

Additional indicia are printed on the playing surface of the board 10, which lies within the oval track 18. An arrangement, or array 20, of numbered squares is printed on the playing surface immediately within the confines of the oval track 18, and surrounding a centrally-extending, elongated, rectangular portion 22 of still further indicia described below. The numbered squares array 20 is herein depicted, by way of example only, as two sets of numbers, each set including five rows and 30 columns of squares, with a set on either side of the central portion 22 to provide a more symmetrical numbered array 20 for all drivers to shoot at. Each square is on the order of one inch square, and is so numbered as to provide a totally random arrangement of numbers. The numbers six and nine have been deleted so as to minimize confusion caused by their inverted symmetry. Obviously, all numbers one through nine, or a totally different set of numbers, may be employed, and any geometrical shape and/or numerical arrangement of numbered squares may be used within the confines of the oval track 18. The numbered squares array 20 provides an indicia portion of the playing piece movement means which, in conjunction with the driver-actuated portion of the movement means 14, determines the advancement of the respective race cars 12.

The center elongated rectangular portion 22 contains various other indicia pertinent to the game. Thus, the portion 22 includes two identical "laps" charts 24 for designating the number of laps to be raced, as well as the number of laps completed by each driver as the race progresses. A lap chart is provided at either end of the center portion 22 to allow more convenient access to all drivers. As more clearly shown in FIG. 2, four rows of seven circles are provided in each laps chart 24, one row for each lane 16, with each of the rows of circles numbered one through seven, designating one through seven laps. Of course, any practical and convenient number of circles may be used. Each row is color-coded red, green, blue and yellow corresponding to the race car colors. A black rectangular marker 26 is placed over a transverse line of circles of the four rows (in each chart 24) to designate the number of laps to be run, i.e., the marker 26 herein is shown placed over the number "3" circles of the charts 24 (see FIG. 2) to indicate to all drivers that three laps constitutes the length of the race. Four annular black lap markers 28 are also provided on the laps chart 24, one being assigned to each driver, and are used to represent the red, green, blue and yellow race cars, respectively. Each lap marker 28 is moved along its respective colored row of circles as each respective driver completes his corresponding laps, whereby the black circular markers 28 identify the number of laps completed by each driver. A driver may use either of the lap charts 24, i.e., the chart which is most convenient to his position at the board.

Although the rows of the lap charts 24 are herein color-coded, the charts may be done in black, and the four annular lap markers 28 may be color-coded whereby each driver selects the lap marker of the same color as his race car.

A center bonus section 30 of the elongated rectangular portion 22 is included in essence as an extension of the numbered squares array 20, and is assigned the highest number, "10", thereby providing the greatest number of moves available to a player/driver if he is skilled enough to project his movement means onto the section 30.

However, immediately adjacent the bonus section 30 are multiple penalty sections 32, 34 and 36, 38 which designate penalty areas, i.e., crash/wreck and pit stop penalty sections. The crash and wreck sections 32, 34, respectively, constitute crash/wreck penalty areas. Similarly, the pit stop sections 36, 38 constitute identical pit stop penalty areas. The sections are split herein to provide generally a more symmetrical playing surface to opposing drivers at the board. Obviously, other arrangements are possible for the relative locations of the various penalty sections 32–38 and of the bonus section 30, as well as their positions relative to the lap charts 24 and the numbered squares array 20.

The track 18 includes a start/finish line 40, with a checkered area 42 corresponding to the last space in each lane 16 prior to the line 40, upon which the race cars 12 are placed prior to the start of the race, and also whenever a driver must return his race car to re-start a lap, as when penalized. A lap, or the race, is completed when a race car reaches the checkered space 42 in its respective lane 16.

The player-actuated movement means 14 of given colors corresponding to the colors of the respective race cars 12, are assigned to each participating driver. Each of the movement means 14 includes a round felt launching pad 44, a solid flat plastic flipper disc 46 and ten annular flat plastic "wheelies" 48, the latter symbolizing race car tires. Each driver is also assigned one of the four black lap markers 28 which, prior to the start of the game, he places on the first circle of the laps chart row corresponding to the respective color.

The game board indicia further includes crash/wreck and pit stop card squares 50, 52, respectively, at respective corners of the board 10 (FIG. 1). The card squares 50, 52 are used along with decks of crash/wreck and pit stop card decks 54, 56, respectively, in an alternative mode of play further described below. Each penalty card in the pit stop deck 56 designates specific and varied penalties for a driver whose wheelie lands in either of the pit stop sections 36, 38. Each of the crash/wreck cards have a number corresponding to the numbers in the array 20 and the bonus section 30; i.e., "1" through "5", "7", "8" or "10", printed on the face thereof. If a driver lands a wheelie in either of the crash/wreck sections 32, 34 he must land a wheelie on a matching number on the squares array 20 on a subsequent turn, or turns, before he can resume moving his race car 12.

As previously mentioned, the numbered squares array 20 and the bonus section 30 comprise an indicia portion of the movement means, and the player-assigned/actuated portion of the movement means 14 cooperates therewith to provide the combined movement means for determining the number of spaces moved by a race car in a lane, in the forward direction. To this end a driver, when taking his turn, places a wheelie 48 on his launching pad 44, and presses down on the edge thereof nearest him with an edge of his flipper 46. Drawing back slightly with the flipper 46 while continuing downward pressure, imparts a propelling force to the wheelie 48, causing it to flip into the air and hopefully onto the numbered squares array 20 or the bonus section 30 (see FIG. 3). After a given amount of practice, a driver can acquire sufficient skill to control the arc and length of travel of a wheelie to cause it to land on a square containing one of the larger numbers, e.g., a number "7" or "8", or to cause it to accurately land on the relatively larger-sized bonus section 30 containing the largest number "10". However, any driver attempting to land a wheelie 48 on the bonus section 30 runs the risk of getting an undesirable penalty by inadvertently propelling the wheelie onto the adjacent wreck/crash penalty sections 32, 34, or onto the pit stop sections 36, 38, instead.

The description of the auto racing game may be more clearly understood by a description of the preferred or basic mode, and also of the various alternative modes for playing the game. Thus, two, three or four player/-drivers may play the game, positioned at sides and/or ends of the game board 10. In the event more than four wish to play the game, drivers may play as partners, with two players sharing the same race car 12, movement means 14, etc.

Each driver picks a race car 12, a flipper 46 and ten wheelies 48 of a preferred color, and also a felt launching pad 44, and an annular black lap marker 28. The pad, flipper and wheelies are placed before him on the table, adjacent the board 10 at his position. The race cars 12 are assembled on the checkered spaces area 42 at the start line 40. The rectangular black lap markers 26 are each placed on the desired line of circled numbers of respective lap charts 24 to designate the number of laps to be raced. The annular black lap markers 28 are placed on the lap chart 24 which is most convenient to the driver, on the first un-numbered circles, as depicted in FIG. 2.

To start the game, each driver, in clockwise direction about the board, shoots a wheelie onto the numbered squares array 20, or the bonus section 30. The driver with the highest lag number starts the race, and the remaining drivers take their turns in clockwise order. The seating order may also be determined in similar manner; viz, the driver with the highest lag number also selects the chair, ie., the corresponding position at the game board, of his choice. The remaining drivers are seated in clockwise order, as determined by their respective lag numbers, in descending sequence.

Figure 3:
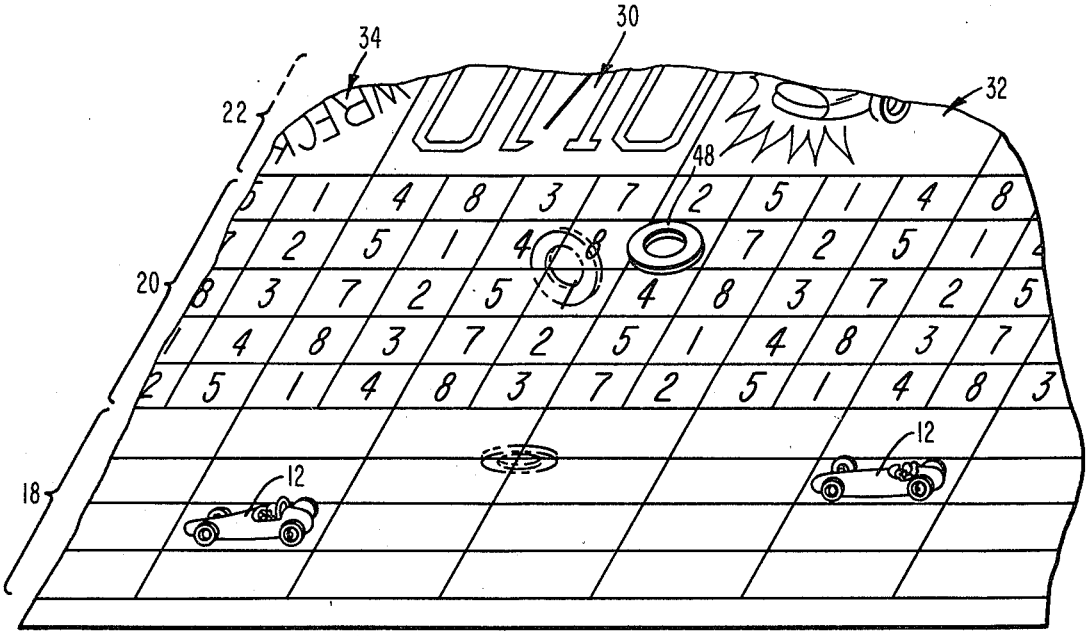
FIGS. 3, 4 and 5 are perspectives showing various methods for launching, propelling, etc., a wheelie onto the playing surface.
Figure 3:
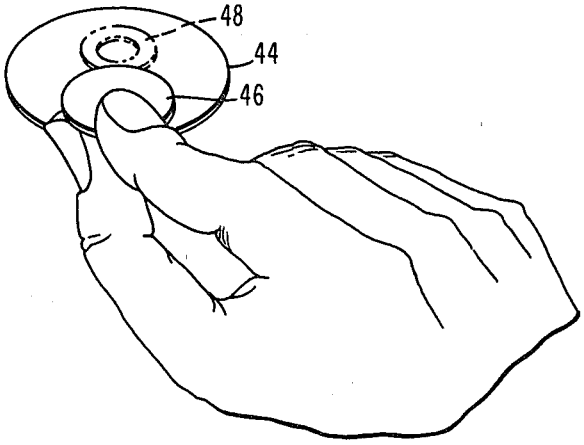

Play is initiated by the first driver, who launches a wheelie 48 onto the playing surface in an attempt to land it on a desired high number of the squares array 20, or in the bonus section 30. In the preferred launching method the wheelie 48 is launched from the driver's pad 44, using his flipper 46, as depicted in FIG. 3. The driver then moves his race car 12 forward the number of spaces designated by the number within the square upon which his wheelie landed. If a wheelie 48 is launched and does not land on a numbered surface, the driver's race car remains on the same space and play is passed to the next driver. If a wheelie lands on the dividing lines between two or more squares, the number in the square covered by the largest part of the wheelie determines the number of spaces moved. If the wheelie lands in the bonus section 30, the driver moves his race car forward the maximum number of ten spaces.

At such time as a driver completes a lap, his lap marker 28 is moved forward one number to designate the total number of laps completed. The first driver to move his lap marker 28 over the circle covered by the black rectangular marker 28, has completed the number of laps required and wins the race.

If a driver launches his wheelie onto either the crash or wreck penalty sections 32, 34, he must return his race car 12 to the start line 40, i.e., to his lane space in the checkered area 42, and must start the lap over again. The second time a driver lands his wheelie in a crash/-wreck section, he returns his car to the start line 40, loses all accumulated laps, and begins the entire race over again. The third time a driver "crashes" or "wrecks", his race car is removed from the game board and he is out of the race.

If a driver launches a wheelie 48 onto either of the pit stop penalty sections 36, 38, he loses his next turn at play. The race car remains in its space until the driver resumes play on his next turn.

The wheelies 48 may remain on the playing surface of the board 10 as long as their numbers do not interfere with, or obstruct, the play by the drivers. At any time, play may be interrupted at the request of one or more drivers, to remove all wheelies on the playing surface with each driver claiming those wheelies corresponding to his selected color.

The launching pads 44, and thus the point from which a driver launches his wheelie, may be moved along the respective edge of the board 10, a distance sufficient to allow the driver a direct shot at a square corresponding to a specific or desired number; i.e., as when one or more race cars may block his shot path to a desired number.

As previously described and shown in FIG. 3, in the preferred launching method, wheelies are launched using the pad 44 and flipper 46, to cause the wheelie to flip from the pad to the playing surface in an arced curve, a straight line, etc. This method is the most exciting and satisfying method of launching a wheelie since it requires the exercise of skill and coordination on the part of the drivers.

Figure 4:
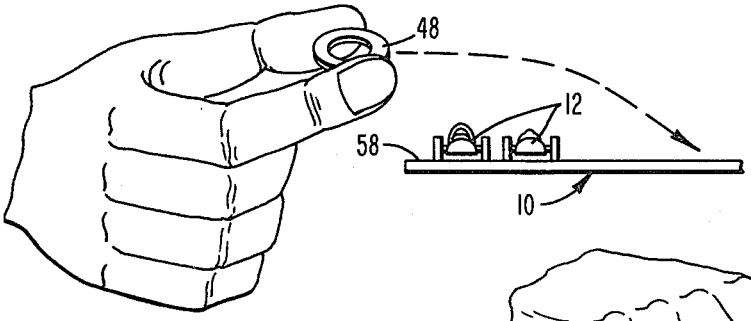

In addition, however, wheelies 48 may be launched as shown in FIG. 4 by tossing them toward the playing surface of the board 10 by holding them, for example, between the thumb and forefinger, and then snapping the wrist to propel them onto the board. The wheelies should be released prior to the fingers crossing the outside edge 58 of the track 18.

Figure 5:
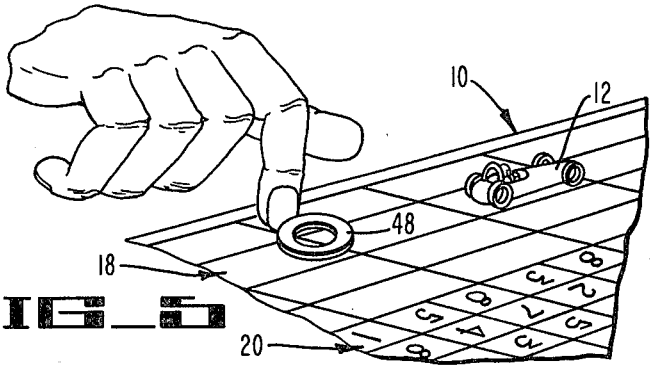

In a further method of launching a wheelie, FIG. 5, the wheelie is placed on the board 10 at the outside edge of the track 18. The wheelie 48 then is launched by sharply snapping a finger, i.e., the fingernail, against the edge thereof, to propel the wheelie in sliding fashion across the playing surface of the board 10.

There are several variations in the above basic mode of play, that may be instituted by the participating drivers, particularly in the case of experienced players. One such alternate mode of play employs the decks of crash/wreck and/or pit stop cards 50, 52, respectively. To this end, the 20 pit stop cards are shuffled and stacked face down on the pit stop card square 52. When a driver lands a wheelie 48 on either of the pit stop penalty sections 36, or 38, he does not automatically lose his next turn as previously described in the basic mode of play, but instead must draw the top pit stop card of the stacked deck 56. The driver then follows the directions on the card explaining the penalty. The card then is placed face up at the bottom of the deck 56. When all cards have been used, the deck is re-shuffled, and play continues.

In a further mode of play, the eight crash/wreck penalty cards in the deck 54 are shuffled and each driver selects two cards from the deck. The cards have a number printed thereon corresponding to one of the numbers of the squares array 20 of the bonus section 30. The two cards are placed face down before each driver. During this alternate mode of play, if a driver should land a wheelie 48 in a crash/wreck section 32, or 34, he does not automatically lose a lap, or laps, as in the basic mode of play, but instead turns over the top crash/-wreck card before him. The driver on his next, or succeeding turns, must then land his wheelie on that number of the numbered squares array 20, or of the bonus section 30, which matches the number printed on the crash/wreck penalty card which he turned face up. The race car remains in the space until such time as the driver matches the number, whereupon the race car is moved the matching number of spaces, the card is placed face down on the crash/wreck card square 50, and the driver resumes normal play.

If the driver, during subsequent play, again lands a wheelie on one of the crash/wreck penalty sections 32, 34, he again must match the number on his second crash/wreck card before he can resume moving his race car. If the driver, in subsequent normal play, lands a wheelie in a crash/wreck penalty section 32 or 34 for the third time, he must remove his race car 12 from the track 18 and is out of the race entirely. The race continues with the remaining drivers. In the event other drivers are penalized from the game, the race is won by the sole remaining driver.

If a wheelie should land on any penalty section 32–38 while a driver is trying to match a number to get back in the race, there is no further penalty, and the driver may continue to match the number on his next and subsequent turn.

In a further alternate mode of game play, when a driver approaches the finish of the last lap, i.e., when he is ten or less spaces from the checkered space in his lane, he must land his wheelie on the number in the array 20 or in the bonus section 30, corresponding to the number of spaces remaining. Thus, if in a previous turn, a driver's race car 12 is moved to a space which is five spaces away from the start/finish line 40, he must land his next wheelie on a square numbered "5", in order to finish the race. If the driver lands his wheelie on a number greater than five, he cannot move his race car but must await his next turn to try again. If the driver lands his wheelie on a numbered square less than five, e.g., on a "3" square, he must move the race car forward the number, i.e., three spaces. On his next turn, the driver must then land his wheelie on a "2" square in order to finish the race. Thus, a driver can win the race only by landing his wheelie on the square having the number which matches the number of spaces his car is from the start/-finish line 40. This latter alternate mode of play may be made part of the basic mode, particularly for experienced player/drivers.

Although a rectangular board 10, with four oval lanes 16 is depicted herein, the board may be hexagonal, octagonal, round, etc., with a track configuration other than oval, e.g., round, hexagonal, etc. In such a game, six, eight, etc., lanes may be employed, with a corresponding number of drivers, race cars, movement means, etc.

Figure 6:
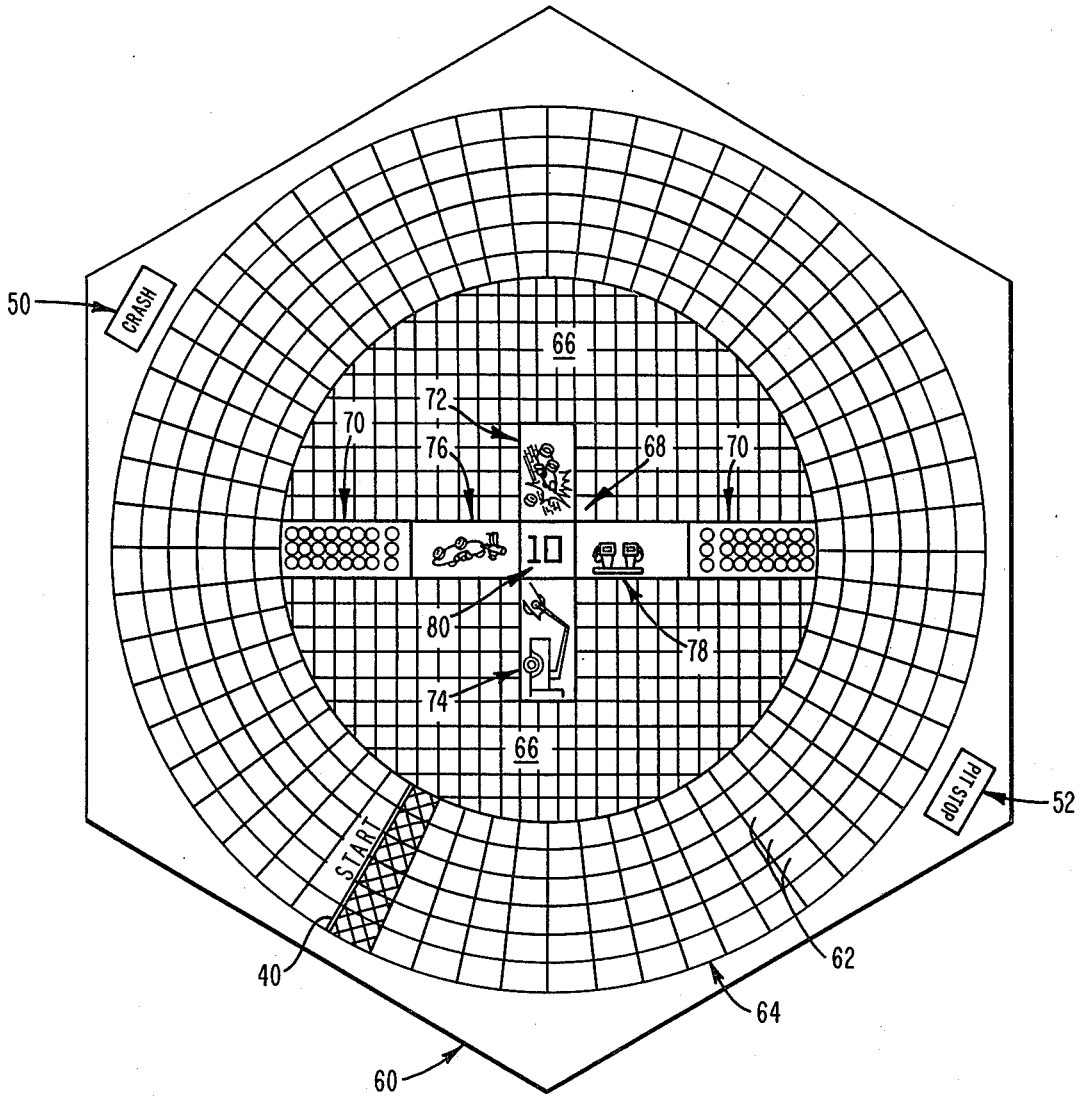
FIG. 6 is a plan of an alternative game board of the invention employing a hexagonal configuration and a circular track and numbered array.

To this end, by way of example, FIG. 6 depicts a game board 60 with a hexagonal board geometry and six lanes 62 in a circular track 64, which accordingly may be played by up to six player/drivers. A numbered squares array 66 is disposed within the confines of the circular track 64, generally symmetrically at either side of a centered, rectangular cross-portion 68. The latter cross-portion includes the various bonus and penalty sections, and the laps charts, of previous description; i.e., opposing laps charts 70, crash/wreck sections 72, 74 and pit stop sections 76, 78. Cross-portion 68 also includes a bonus section 80 at the very center of the board 60. The race cars 12, markers 26, 28, the cards 54, 56, and player-actuated movement means 14 are identical to those of the previous FIGURES. Additional sets, pieces, etc., are included in the embodiment of FIG. 6, as required. Game play is similar to that of the previous FIGURES.

We claim:

1. An auto racing game apparatus to be played by a plurality of drivers and including a playing board and a plurality of movable playing pieces, comprising;

a rectangular playing surface on a rectangular board;

a generally oval race track of multiple lanes disposed along the outer border of the rectangular playing surface;

a preselected array of a large plurality of numbers disposed in selected orientation on the playing surface;

a bonus area on the playing surface containing a number of relatively larger value than the largest number in the numbered array;

areas of preselected penalties intermixed with the array of numbers on the playing surface and indicative of problems encountered by a driver in the course of a race, and including opposing pit stop and crash/wreck sections disposed adjacent and bordering the bonus area, wherein the numbered array is disposed between the race track and the penalty sections/bonus area;

driver-actuated movement means including a launchable number selecting member defined by a small flat disc for launching in free flight toward the array of numbers on the playing surface by a respective driver, to coact with the array of numbers by determining a number in the array or a penalty in the penalty areas, to thus determine the extent of movement of the movable playing pieces;

said driver-actuated movement means including a launching pad and launching flipper means, wherein the disc is placed on the pad and launched therefrom by pressure from the flipper means exerted by the driver; and wherein the areas of preselected penalties coact with the number selecting member to determine a penalty rather than a forward extent of movement when a disc erroneously lands on the penalty areas rather than on the array of numbers.

2. An auto racing game apparatus to be played by a plurality of drivers and including a playing board and a plurality of movable playing pieces, comprising;

a hexagonal playing surface on a hexagonal playing board;

a generally circular race track of multiple lanes disposed along the outside border of the hexagonal playing surface;

a preselected array of a large plurality of numbers disposed in selected orientation on the playing surface;

a bonus area on the playing surface containing a number of relatively larger value than the largest number in the numbered array;

areas of preselected penalties intermixed with the array of numbers on the playing surface and indicative of problems encountered by a driver in the course of a race, and including opposing pit stop and crash/wreck sections disposed adjacent and bordering the bonus area, wherein the numbered array is disposed between the race track and the penalty sections/bonus area;

driver-actuated movement means including a launchable number selecting member defined by a small flat disc for launching in free flight toward the array of numbers on the playing surface by a respective driver, to coact with the array of numbers by determining a number in the array or a penalty in the penalty areas, to thus determine the extent of movement of the movable playing pieces;

said driver-actuated movement means including a launching pad and launching flipper means, wherein the disc is placed on the pad and launched therefrom by pressure from the flipper means exerted by the driver; and wherein the areas of preselected penalties coact with the number selecting member to determine a penalty rather than a forward extent of movement when a disc erroneously lands on the penalty areas rather than on the array of numbers.

3. An auto racing game apparatus to be played by a plurality of drivers and including a playing board with indicia on a playing surface thereof defining a race track with multiple lanes and a plurality of movable playing pieces, comprising:

indicia on the playing surface defining a preselected numbered array formed of a large plurality of numbers disposed in a random orientation and geometrical order of a plurality of rows and columns within the confines of the race track;

said playing board and surface being rectangular, with the race track being generally oval and disposed along the outer border of the rectangular playing surface;

indicia on the playing surface defining areas of preselected penalties and including at least one pit stop and one crash/wreck section indicative of problems encountered by a driver in the course of a race;

indicial on the playing surface and selectively bordered by the penalty areas and defining a bonus area containing a number of relatively larger value than the largest number in the numbered array;

the penalty areas including opposing pit stop and crash/wreck sections disposed adjacent the bonus area, wherein the numbered array is disposed between the race track and the penalty sections/-bonus area;

driver-actuated movement means including a launchable number selecting member for launching toward the array of numbers to determine the extent of movement of the movable playing pieces;

said movement means including alaunching pad, launching flipper means, and a small flat disc which is placed on the pad and launched therefrom onto the playing surface by pressure from the flipper means exerted by the driver, to determine a number in the array, or a penalty in the penalty areas; and the preselected penalties being assessed to a driver whose number selecting member erroneously lands on the penalty areas rather than on the array of numbers.

4. An auto racing game apparatus to be played by a plurality of drivers and including a playing board with indicia on a playing surface thereof defining a race track with multiple lanes and a plurality of movable playing pieces, comprising;

indicia on the playing surface defining a preselected numbered array formed of a large plurality of numbers disposed in a random orientation and geometrical order of a plurality of rows and columns within the confines of the race track;

said playing board and surface being hexagonal, with the race track being generally circular and disposed along the outside border of the hexagonal playing surface;

indicia on the playing surface defining areas of preselected penalties and including at least one pit stop and one crash/wreck section indicative of problems encountered by a driver in the course of a race;

indicia on the playing surface and selectively bordered by the penalty areas and defining a bonus area containing a number of relatively larger value than the largest number in the numbered array;

the penalty areas including opposing pit stop and crash/wreck sections disposed adjacent the bonus area, wherein the numbered array is disposed between the race track and the penalty sections/-bonus area;

driver-actuated movement means including a launchable number selecting member for launching toward the array of numbers to determine the extent of movement of the movable playing pieces;

said movement means including a launching pad, launching flipper means, and a small flat disc which is placed on the pad and launched therefrom onto the playing surface by pressure from the flipper means exerted by the driver, to determine a number in the array, or a penalty in the penalty areas; and the preselected penalties being assessed to a driver whose number selecting member erroneously lands on the penalty areas rather than on the array of numbers.

* * * * *